US006865831B2

(12) United States Patent
Launey

(10) Patent No.: US 6,865,831 B2
(45) Date of Patent: Mar. 15, 2005

(54) MEMORY ALBUM PAGE

(76) Inventor: Kurt C. Launey, 2053 Laurel Ave., Terrytown, LA (US) 70056

( * ) Notice: Subject to any disclaimer, the term of this patent is extended or adjusted under 35 U.S.C. 154(b) by 40 days.

(21) Appl. No.: 10/278,413

(22) Filed: Oct. 22, 2002

(65) Prior Publication Data

US 2004/0074117 A1 Apr. 22, 2004

(51) Int. Cl.[7] ..... G09F 1/00
(52) U.S. Cl. ..... 40/124.02; 362/554; 362/565
(58) Field of Search ..... 40/124.02, 124.191, 40/541; 362/554, 551, 565

(56) References Cited

U.S. PATENT DOCUMENTS 3,624,385 A * 11/1971 Wall ..... 362/565
4,209,824 A * 6/1980 Kaufman ..... 362/98
4,286,399 A * 9/1981 Funahashi et al. ..... 40/124.02
4,299,041 A 11/1981 Wilson
4,363,081 A * 12/1982 Wilbur ..... 362/98
4,559,583 A * 12/1985 Ku ..... 362/565
4,754,372 A * 6/1988 Harrison ..... 362/565
4,875,144 A * 10/1989 Wainwright ..... 362/103
4,882,865 A 11/1989 Andeweg
5,113,325 A 5/1992 Eisenbraum
5,147,129 A 9/1992 Ku
5,639,156 A 6/1997 Broxson
5,683,762 A 11/1997 Banschick
5,861,801 A 1/1999 Cullen
5,944,416 A * 8/1999 Marsh ..... 362/568
6,015,218 A 1/2000 Snell
6,106,130 A 8/2000 Harding
6,265,984 B1 7/2001 Molinaroli
6,280,045 B1 8/2001 Anteby et al.
6,283,414 B1 9/2001 Quinones et al.
6,409,357 B1 6/2002 Thompson et al.

* cited by examiner

*Primary Examiner*—Gary C. Hoge
(74) *Attorney, Agent, or Firm*—Keaty Professional Law Corporation

(57) ABSTRACT

A page for a memory album or a scrapbook has an illumination assembly secured on the back surface of the page. The illumination assembly has a power source and one or more light emitting members powered by the power source. The light emitting member(s) are mounted opposite one or more openings formed in the page to allow light emitted by the light emitting member to be visible on the front surface of the page. An on/off switch is mounted opposite another opening formed in the page to allow a user to selectively activate the light emitting member. One or more fiber optic bundles may be detachably secured to the light emitting members in light transferring relationship by mounting bases of the fiber optic bundles over the light emitting members and securing them by a detachable sleeve placed over the base of the bundle and the light emitting member. The illumination assembly allows personalization of the design on the page of the scrapbook.

4 Claims, 3 Drawing Sheets

MEMORY ALBUM PAGE

BACKGROUND OF THE INVENTION

This invention relates to a memory album and, more particularly, to an album for the collection and retention of memorabilia items in an album or a scrapbook.

Collection and retention of memorabilia items has long been a favorite hobby of many individuals. Photo albums have been extensively used for retaining photographs on photo album pages by positioning photographs in specially provided pockets, retaining photographs between a firm page and a transparent cover, by engaging corners of the photographs in mounted brackets attached to the photo album page and by other similar means.

In recent years, collectors and hobbyists have been using the so-called "scrapbooks" for retaining objects that have monetary or purely sentimental value. Some of the items retained in the scrapbook pages may be collectibles that have historic value, such as invitations to important political functions, concert tickets, letters from notable individuals and the like. However, majority of the individuals uses scrapbooks for retaining items of purely sentimental value, such as photographs, wedding invitations, graduation announcements, etc.

Scrapbooks are available from a variety of sources in different designs, varying in shapes, sizes, number of pages in the scrapbook, etc. Generally scrapbooks have front and back covers of sturdy construction joined by a spine with a plurality of pages retained between the covers. The pages themselves are designed for retaining photographs, drawings, dry flowers, etc.

The pages that are incorporated into the scrapbooks are usually blank, allowing the user to display the items in any desired order on the page. The individual may incorporate writings, drawings, and other personalized touches to the pages of the scrapbook to accompany the memorabilia items and make the story "come to life" for the person glancing through the scrapbook. Art supply and stationary stores also sell a variety of preprinted designs that can be glued to the page together with a photograph, invitation, or a postcard to further personalize the scrapbook page.

The present invention contemplates provision of a means for personalizing the pages of a memory album, such as a scrapbook, by incorporating an illumination means secured to the back of a scrapbook page.

SUMMARY OF THE INVENTION

It is, therefore, an object of the present invention to provide a kit for personalizing memory album pages with an illumination means.

It is another object of the present invention to provide a memory album page that can be personalized by incorporating an illumination means into the viewing area of the page.

It is a further object of the present invention to provide a page for a scrapbook, which can be illuminated by a light emitting diode in a variety of locations on the page.

These and other objects of the present invention are achieved through a provision of a page for a memory album or a scrapbook that has an illumination assembly secured to the back of the page. The illumination assembly has an independent power source, such one or more flat batteries affixed to a flat carrier. The batteries power one or more light emitting members, which can be LEDs or chip diodes. An on/off switch controls activation of the light emitting members.

The light emitting members are provided with individual plugs, which are inserted into receptacles connected to the batteries. A user can selectively provide one or more light emitting members per page by engaging the plug of the light emitting member with a respective receptacle, depending on the design desired by the user. The page carrying the illumination assembly may be attached, back-to-back, with the adjacent scrapbook page to conceal the illumination assembly. To protect the page and the illumination assembly, both pages, or just one page, may be enclosed in a transparent cover.

An illumination kit for use with a memory album or a scrapbook comprises a power source and at least one light emitting member, which can be secured on a flat carrier, An on/off switch is provided in electrical connection between the power source and the light emitting member; all connected by suitable wiring. The kit may have a plurality of receptacles for receiving plugs of a desired number the light emitting members. The light emitting members may provide "blinking" effect, be color-coordinated with the design on the scrapbook page and have various sizes.

A second embodiment of the invention incorporates one or more fiber optic bundles that transmit light emitted by the light emitting members to various positions on the page of the memory album. The bundles are secured, with their bases over the light emitting members, in a light-transferring relationship to the LEDs. A detachable sleeve covers the base of the bundle and the LED, temporarily securing the bundle base to the LED.

If desired a "blinking" element may be positioned between the power source and the LED to cause an on/off effect to the light rays travelling from the LED through the fiber optic strands.

BRIEF DESCRIPTION OF THE DRAWINGS

Reference will now be made to the drawings, wherein like parts are designed by like numerals and wherein:

FIG. 2 is an exploded view of a pair of scrapbook pages with the illuminating means mounted there between.

DETAILED DESCRIPTION OF THE PREFERRED EMBODIMENT

Figure 1:
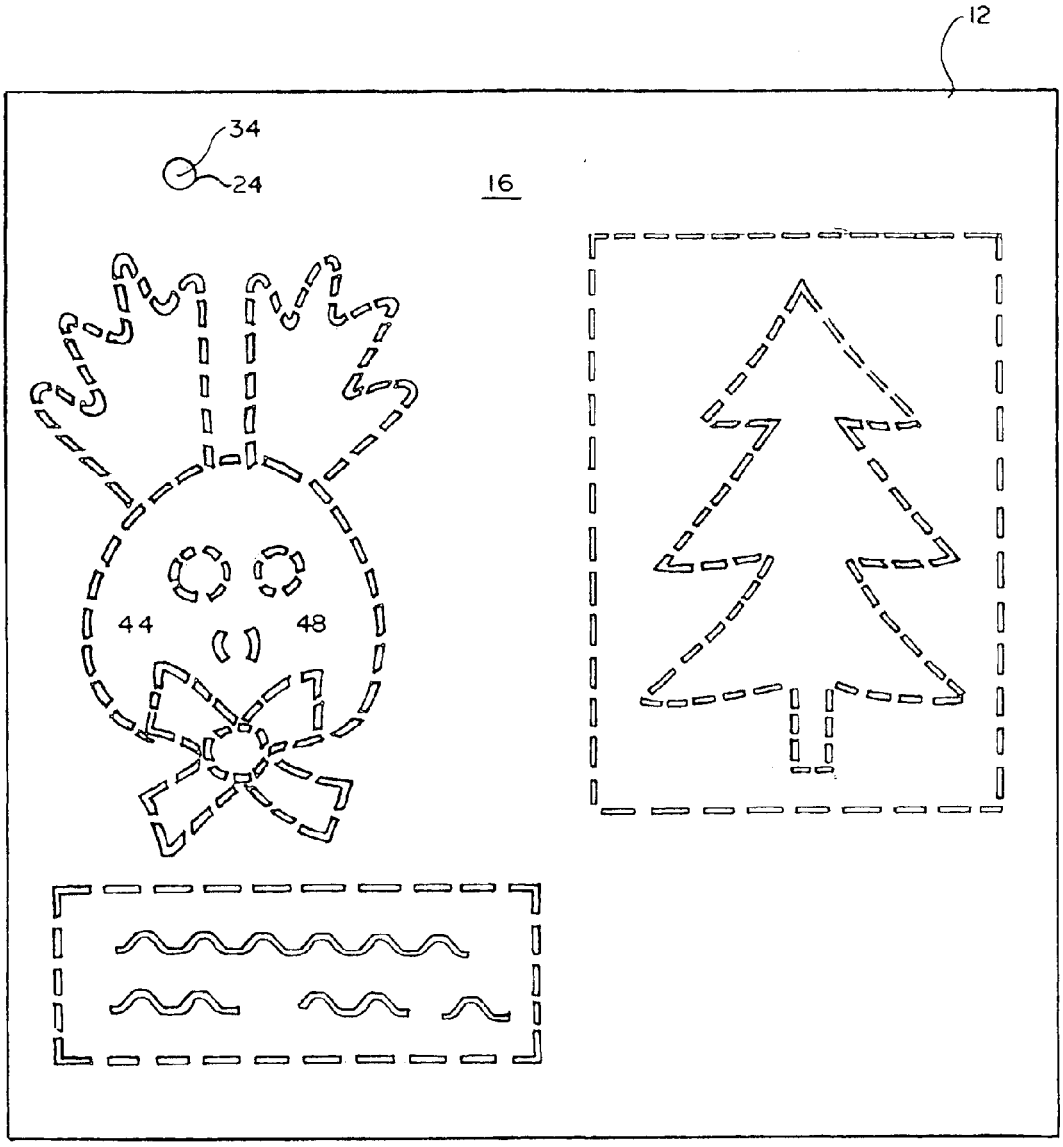
FIG. 1 is a perspective view of a memory album page incorporating an illumination means in accordance with the present invention.
Figure 2:
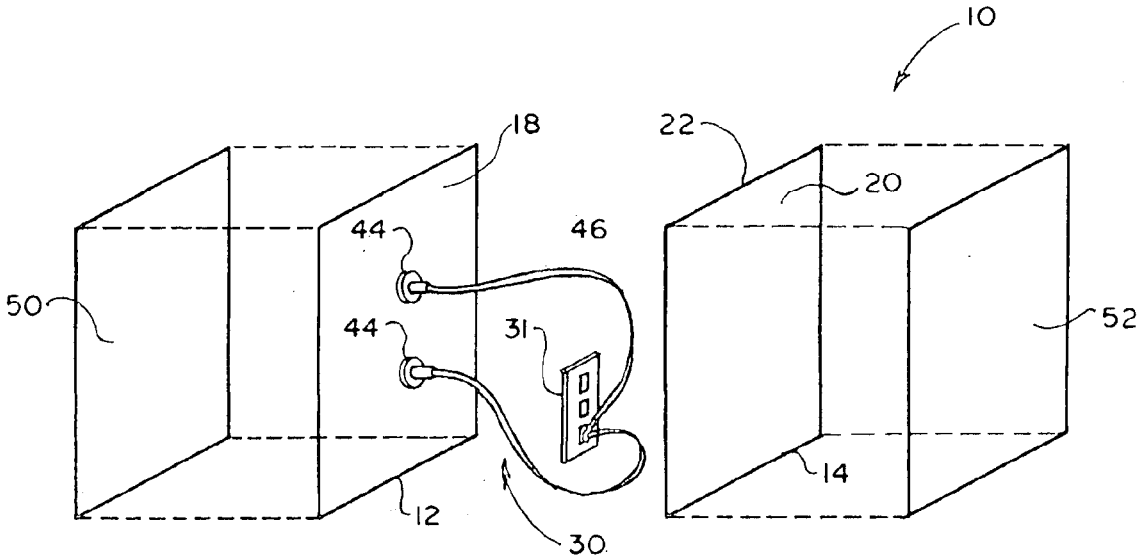
Figure 3:
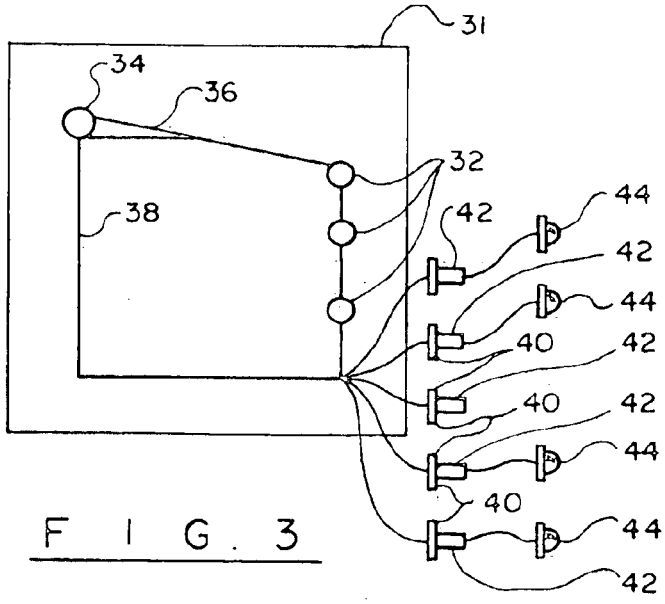
FIG. 3 is a detail schematic view illustrating the illumination kit of the present invention.
Figure 4:
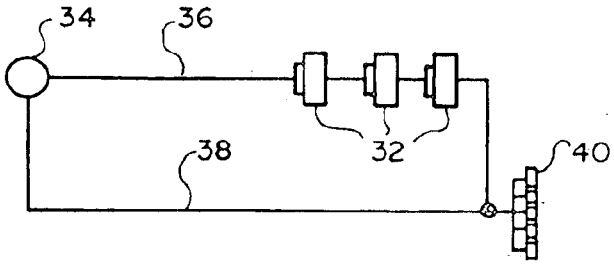
FIG. 4 is a detail schematic view illustrating a simplified wiring diagram of the illumination kit of the present invention.

Turning now to the drawings in more detail, numeral 10 designates a portion of a memory album with the illumination kit in accordance with the present invention. A memory album comprises a plurality of pages; two of these pages can be seen in FIGS. 1 and 2. Conventionally, the pages in the album or a scrapbook have identical shape and size. While only two pages are shown in FIG. 2, it will be apparent to those skilled in the art that such pages can be duplicated with the scrapbook numerous times, depending in the width of the spine of the scrapbook.

The first sheet 12 has a front surface 16 and a back surface 18. The second sheet 14 has a front surface 20 and a back surface 22. As shown in FIG. 1, an opening 24 is formed through the sheet 12 to expose an on/off switch 34, as will be explained in more detail hereinafter.

Sandwiched between the back surfaces 18 and 22 is an illumination assembly 30 that comprises a carrier 31 that has a shape and size smaller than the size of the sheets 12 and 14. A plurality of batteries 32 are secured on the carrier 31. The batteries 32 are connected by suitable wiring 36 to an on/off switch 34.

Lengths of wire 38 connect the batteries 32 and the switch 34 with one or more outlets 40. The outlets 40 are female receptacles for plugs, or male connectors 42 that connect the batteries 32 and the switch 34 to light emitting members 44. The light emitting members 44 are connected to the plugs 42 by suitable wiring 46.

A through opening 48 (FIG. 1) is formed in the body of the sheets 12 and 14 to allow light rays to be emitted by the light emitting members 44 and to be visible from the front surfaces 16 and 20 of the sheets 12 and 14. In the example illustrated in FIG. 1, the opening 48 allows light from the light emitting member 44 to illuminate a reindeer's nose.

In a similar manner, a number of openings can be formed through the pages 12 and 14 to allow positioning of the light-emitting members 44 in a variety of desired locations on the sheets 12 and 14. The light emitting members 44 can be arranged for illumination of stars, points of interest, and other locations on a memory album page as desired by the user.

The carrier 31 can be adhered to the back surfaces 18 or 22 of the sheets 12 and 14, such that it lies flat against the surfaces 18 and 22. The batteries 32 are flat batteries, such as for instance small watch batteries, that present minimal thickness when secured on the carrier 31. The wiring can be arranged to lie flat against carrier 31 and against the back surfaces 18 and 22 so as not to substantially increase the thickness of the page of the memory album. If desired, the wiring may be secured by an adhesive tape to the back surfaces of the sheets 12 and 14, so as to prevent "bunching" of wires near the carrier 31.

The on/off switch 34 is a flat button-type switch that is depressed to form an electrical connection between the batteries 32 and the female plug members 40, then the light emitting members 44. The light-emitting members 44 can be chip diodes or light emitting diodes (LEDs), which are readily available from a variety of sources. The light emitting members 44 can be color coordinated with the design on the page.

Once the illumination assembly 30 is positioned between the sheets 12 and 14 and secured to at least one of the sheets, the sheets 12 and 14 may be secured together to conceal the illumination assembly 30 between the sheets. The on/off switch 34 is accessible from the front surface 16 of the sheet 12 to allow the user to easily turn the light on and off when viewing the memory album page. The light-emitting members 44 can be provided with intermittent blinking features to have a "blinking light" effect.

If desired, to further protect the light-emitting assembly 30, as well as the memorabilia item, the sheets 12 and 14 can be enclosed in a page protector pocket that has a first page protector member 50 and a second page protector member 52. The protector members 50 and 52 further ensure secure positioning of the light assembly 30 in relation to the sheets 12 and 14.

The illuminated memory album page of the present invention can be used for enhancing the design on the scrapbook page and illuminating areas of particular interest on the page. If desired, the illumination assembly 30 can be sold separately as a kit, allowing the user to selectively choose the number of light emitting members 44 that are needed for enhancement of a particular page. The illumination assembly 30 can be provided with one or more receptacles 40 along with the necessary number of light emitting members 44 and plugs 42.

A user can easily secure the appropriate number of the outlets to the scrapbook page, be it one page or two pages secured together. If the illumination assembly 30 is sold as a kit, the instructions given to the user may provide for incorporation of a protector envelope or protector sheets for the two adjacent pages.

Depending on the desired design suitable openings 48 for the light-emitting members 44 can be made only in one sheet 12 or 14, with the second sheet 12 or 14 being used in a conventional manner without the illumination features. In that case, the light-emitting members 44 can be extended to illuminate only one sheet, as selected by the user.

The present invention may be used with one- or two-page greeting card. The illumination assembly 30 may be concealed between layer of the front or back sheets of the greeting card. It is envisioned that an on/off switch may be eliminated from the illumination assembly. Instead, opening of the greeting card would trigger the electrical connection between the light emitting member 44 and the power source, or battery 30. Once the card is opened, the light emitting member 44 becomes activated, illuminating the selected design on the visible surface of the greeting card.

Figure 5:
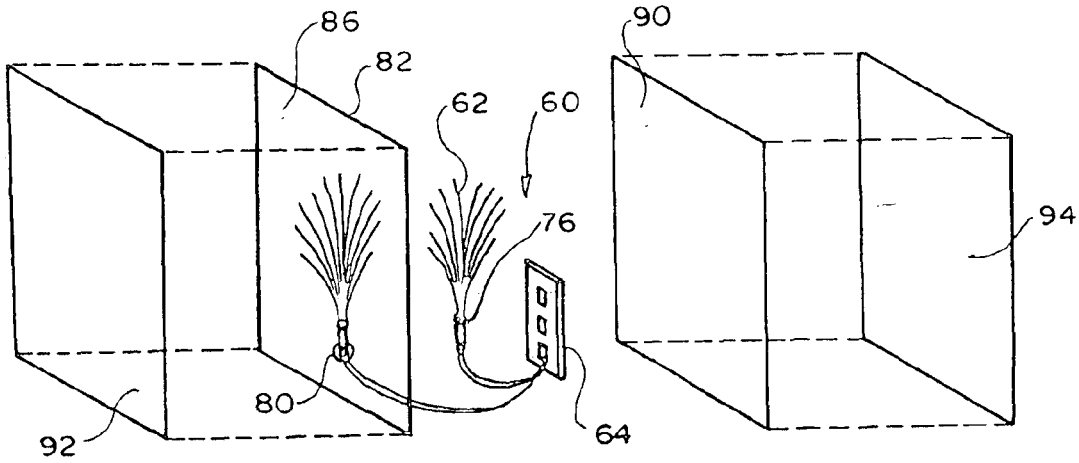
FIG. 5 is an exploded view of the second embodiment of the present invention using fiber optic bundles.
Figure 6:
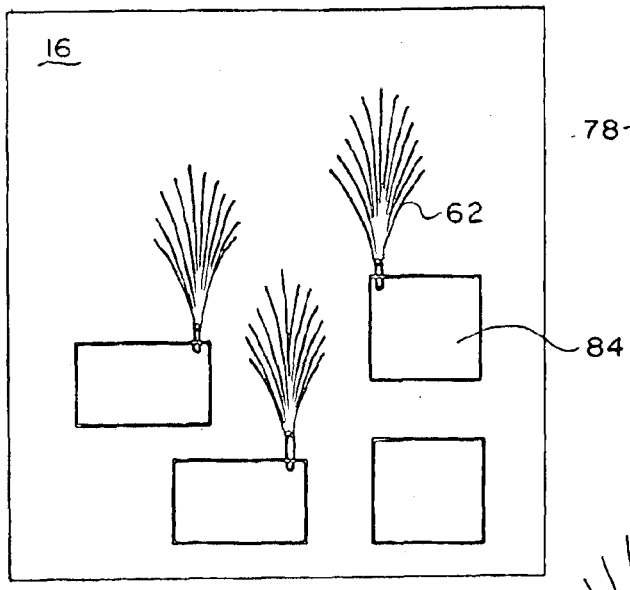
FIG. 6 is a detail view showing the front of a memory album page with the fiber optic bundles incorporated on the page.
Figure 7:
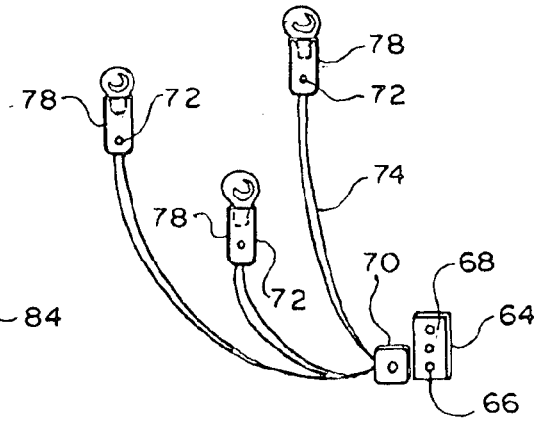
FIG. 7 is a detail view showing the means of attaching the fiber optic bundles to the light emitting means.

Referring now to, the second embodiment of the present invention shown in FIGS. 5–7, the illumination assembly 60 is provided with a secondary illumination means 62, which can be in the form of a bundle of fiber optic strands. Similarly to the first embodiment, the assembly 60 comprises a carrier 64, to which a plurality of power batteries 66 are secured. An on/of switch 68 is electrically connected to the batteries 66 and is secured to the carrier 64.

Figure 8:
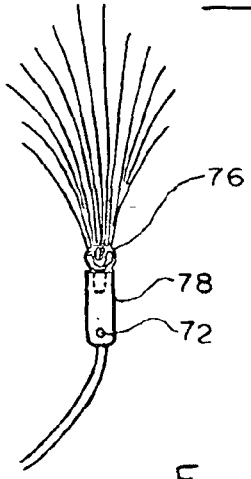
FIG. 8 is a detail view showing position of a sleeve over a light emitting member and a base of a fiber-optic bundle.

If desired, an optional intermittent light module 70 is connected between the batteries and one or more light emitting members 72. The light emitting members 72 are connected to the batteries 66 by suitable wiring 74. Each fiber optic bundle 62 has a base 76, where the strands are tied together. As can be seen in FIG. 8, the base 76 is inserted into a detachable sleeve 78, which is positioned over the light emitting member 72. The base 76 contacts the respective light emitting member 72 and conducts light rays generated by the light emitting member 72 into the strands of the fiber optic bundle 62.

Suitable openings 80 are formed in a sheet 82 to allow the desired number of strands from the bundle 62 to be pulled through the sheet 82. As shown in FIG. 6, the strands may form a "fireworks" display above the picture, or photos 84. Of course, the strands of the bundle 62 may be bent, woven through the page, or placed flat against the sheet 82, depending on the desired effect. The strands of the bundle 62 may be secured by an adhesive tape to a front surface 86 of the sheet 82.

Similarly to the first embodiment, the user may select the number of light emitting members 72 the user wishes to incorporate into the design. The user then attaches the light emitting member(s) to the plugs (not shown) and makes the appropriate number of openings in the sheet 82. The user then forces the base 76 of the bundle 62 through the openings 80 such that the base 76 extends through the openings 80 to the back surface of the sheet 82.

The user then forces the base over the light emitting member 72 and into the sleeve 78. The light emitting member 72 becomes surrounded by the strands of the base, with the sleeve 78 enclosing the light emitting member 72 and the base 76. The bundle 62 is thereby secured in the back of the sheet 82 in a light transmitting relationship with the light emitting member 72.

The carrier 64 can be also secured to the back surface of the sheet 82 by an adhesive tape or glue. A second sheet 90 is pressed against the first sheet 82 to create a page of a memory album. If desired, openings may be made in the second sheet 90 to extend one or more fiber optic strands or entire bundles 62 to the front surface of the second sheet 90. Light assembly is then firmly "sandwiched" between the sheets 82 and 90.

An optional album page protector having one or more sheets 92 and 94 are provided for enclosing the page carrying the fiber optic bundles 62. The light emitting members 72 may be light emitting diodes (LED) that provide different color combinations for the bundles 62. The user may elect to incorporate red, green and yellow to design a "rainbow" effect on the page.

Many other changes and modifications can be made in the design of the present invention without departing from the spirit thereof. I therefore pray that my rights to the present invention be limited only by the scope of the appended claims.

I claim:

1. A memory album page, comprising:

a flat sheet having a front surface and a back surface, said sheet provided with at least one opening therethrough;

an illumination assembly mounted to the back surface of said sheet, said illumination assembly comprising at least one light emitting member emitting light through said opening;

at least one bundle of fiber optic strands for transmitting light emitted by said at least light emitting member to a front surface of said sheet, said at least one bundle of fiber optic strands comprising a base, where strands of said at least one bundle are secured together; and a sleeve sized and shaped to be mounted over said at least one light emitting member, and, wherein said base is inserted into said sleeve in a surrounding relationship over said at least one light emitting member.

2. A kit for illuminating a page in a memory album, the kit comprising:

a carrier;

a power source secured on said carrier;

at least one light emitting member connected to said power source;

at least one fiber optic bundle for transmitting light emitted by said at least one light emitting member to the page of a memory album, said fiber optic bundle comprising a base, where strands composing the fiber optic bundle are secured together, and a detachable sleeve for mounting over said at least one light emitting member and said base, said sleeve selectively securing the fiber optic bundle in a surrounding relationship over said at least one light emitting member.

3. A scrapbook page, comprising:

a first flat sheet having a front surface and a back surface, said first sheet being provided with an opening therethrough;

a second flat sheet having a front surface and a back surface;

an illumination assembly positioned between back surfaces of said first sheet and said second sheet, said illumination assembly comprising at least one light emitting member positioned opposite said opening and at least one bundle of fiber optic strands for transmitting light emitted by said at least light emitting member to a front surface of said second sheet.

4. A scrapbook page, comprising:

a first flat sheet having a front surface and a back surface, said first sheet being provided with an opening therethrough;

a second flat sheet having a front surface and a back surface;

an illumination assembly positioned between back surfaces of said first sheet and said second sheet, said illumination assembly comprising at least one light emitting member positioned opposite said opening and at least one bundle of fiber optic strands for transmitting light emitted by said at least light emitting member to a front surface of said first sheet, said at least one bundle of fiber optic strands comprising a base, where strands of said at least one bundle are secured together; and a sleeve sized and shaped to be mounted over said at least one light emitting member, and wherein said base is inserted into said sleeve in a surrounding relationship over said at least one light emitting member.

* * * * *